US010593338B2

(12) United States Patent
McGrath

(10) Patent No.: US 10,593,338 B2
(45) **Date of Patent: *Mar. 17, 2020**

(54) ENHANCEMENT OF SPATIAL AUDIO SIGNALS BY MODULATED DECORRELATION

(71) Applicant: Dolby Laboratories Licensing Corporation, San Francisco, CA (US)

(72) Inventor: David S. McGrath, Rose Bay (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/276,397

(22) Filed: Feb. 14, 2019

(65) Prior Publication Data

US 2019/0180760 A1 Jun. 13, 2019

Related U.S. Application Data

(63) Continuation of application No. 15/546,258, filed as application No. PCT/US2016/020380 on Mar. 2, 2016, now Pat. No. 10,210,872.

(60) Provisional application No. 62/298,905, filed on Feb. 23, 2016, provisional application No. 62/127,613, filed on Mar. 3, 2015.

(51) Int. Cl.
*G10L 19/008* (2013.01)
*H04S 3/00* (2006.01)

(52) U.S. Cl.
CPC ..... *G10L 19/008* (2013.01); *H04S 3/008* (2013.01)

(58) Field of Classification Search
CPC ... G10L 19/008; G10L 21/0264; G10L 25/06; H04S 2400/11; H04S 3/008
USPC ..... 381/1; 700/94
See application file for complete search history.

(56) References Cited

U.S. PATENT DOCUMENTS

| | | | |
|---|---|---|---|
| 8,363,865 | B1 | 1/2013 | Bottum |
| 9,269,360 | B2 | 2/2016 | McGrath |
| 2009/0240503 | A1 | 9/2009 | Miyasaka |

FOREIGN PATENT DOCUMENTS

| | | |
|---|---|---|
| EP | 2830333 | 1/2015 |
| EP | 2830336 | 1/2015 |
| JP | 2013-517687 | 5/2013 |
| WO | 2011/090834 | 7/2011 |
| WO | 2015/017235 | 2/2015 |

*Primary Examiner* — Paul Kim
*Assistant Examiner* — Douglas J Suthers

(57) ABSTRACT

Some methods involve receiving an input audio signal that includes N input audio channels, the input audio signal representing a first soundfield format having a first soundfield format resolution, N being an integer ≥2. A first decorrelation process may be applied to two or more of the input audio channels to produce a first set of decorrelated channels, the first decorrelation process maintaining an inter-channel correlation of the set of input audio channels. A first modulation process may be applied to the first set of decorrelated channels to produce a first set of decorrelated and modulated output channels. The first set of decorrelated and modulated output channels may be combined with two or more undecorrelated output channels to produce an output audio signal that includes O output audio channels representing a second and relatively higher-resolution soundfield format than the first soundfield format, O being an integer ≥3.

8 Claims, 9 Drawing Sheets

ENHANCEMENT OF SPATIAL AUDIO SIGNALS BY MODULATED DECORRELATION

CROSS-REFERENCE TO RELATED APPLICATIONS

This application is continuation of U.S. patent application Ser. No. 15/546,258, filed Jul. 25, 2017, which is United States National Stage of PCT/US2016/020380, filed Mar. 2, 2016, which claims priority to U.S. Provisional Application No. 62/127,613, filed 3 Mar. 2015, and U.S. Provisional Application No. 62/298,905, filed 23 Feb. 2016, each of which are hereby incorporated by reference in its entirety.

TECHNICAL FIELD

The present invention relates to the manipulation of audio signals that are composed of multiple audio channels, and in particular, relates to the methods used to create audio signals with high-resolution spatial characteristics, from input audio signals that have lower-resolution spatial characteristics.

BACKGROUND

Multi-channel audio signals are used to store or transport a listening experience, for an end listener, that may include the impression of a very complex acoustic scene. The multi-channel signals may carry the information that describes the acoustic scene using a number of common conventions including, but not limited to, the following:

Discrete Speaker Channels: The audio scene may have been rendered in some way, to form speaker channels which, when played back on the appropriate arrangement of loudspeakers, create the illusion of the desired acoustic scene. Examples of Discrete Speaker Channel Formats include stereo, 5.1 or 7.1 signals, as used in many sound formats today.

Audio Objects: The audio scene may be represented as one or more object audio channels which, when rendered by the listeners playback equipment, can re-create the acoustic scene. In some cases, each audio object will be accompanied by metadata (implicit or explicit) that is used by the renderer to pan the object to the appropriate location in the listeners playback environment. Examples of Audio Object Formats include Dolby Atmos, which is used in the carriage of rich sound-tracks on Blu-Ray Disc and other motion picture delivery formats.

Soundfield Channels: The audio scene may be represented by a Soundfield Format—a set of two of more audio signals that collectively contain one or more audio objects with the spatial location of each object encoded in the Spatial Format in the form of panning gains. Examples of Soundfield Formats include Ambisonics and Higher Order Ambisonics (both of which are well known in the art).

This disclosure is concerned with the modification of multi-channel audio signals that adhere to various Spatial Formats.

Soundfield Formats

An N-channel Soundfield Format may be defined by its panning function, $P_N(\phi)$. Specifically, $G=P_N(\phi)$, where G represents an [N×1] column vector of gain values, and $\phi$ defines the spatial location of the object.

$$G_N = \begin{pmatrix} g_1 \\ g_2 \\ \vdots \\ g_N \end{pmatrix} = P_N(\phi) \tag{1}$$

Hence, a set of M audio objects $(o_1(t), o_2(t), \ldots, o_M(t))$ can be encoded into the N-channel Spatial Format signal $X_N(t)$ as per Equation 2 (where audio object m is located at the position defined by $\phi_m$):

$$X_N(t) = \sum_{m=1}^{M} P(\phi_m) \times o_m(t) \tag{2}$$

$$X_N(t) = \begin{pmatrix} x_1(t) \\ x_2(t) \\ \vdots \\ x_N(t) \end{pmatrix} \tag{3}$$

SUMMARY

As described in detail herein, in some implementations a method of processing audio signals may involve receiving an input audio signal that includes $N_r$ input audio channels. $N_r$ may be an integer ≥2. In some examples, the input audio signal may represent a first soundfield format having a first soundfield format resolution. The method may involve applying a first decorrelation process to a set of two or more of the input audio channels to produce a first set of decorrelated channels. The first decorrelation process may involve maintaining an inter-channel correlation of the set of input audio channels. The method may involve applying a first modulation process to the first set of decorrelated channels to produce a first set of decorrelated and modulated output channels.

In some implementations, the method may involve combining the first set of decorrelated and modulated output channels with two or more undecorrelated output channels to produce an output audio signal that includes $N_p$ output audio channels. $N_p$ may, in some examples, be an integer ≥3. According to some implementations, the output channels may represent a second soundfield format that is a relatively higher-resolution soundfield format than the first soundfield format. In some examples, the undecorrelated output channels may correspond with lower-resolution components of the output audio signal and the decorrelated and modulated output channels corresponding with higher-resolution components of the output audio signal. In some implementations, the undecorrelated output channels may be produced by applying a least-squares format converter to the $N_r$ input audio channels.

In some examples, the modulation process may involve applying a linear matrix to the first set of decorrelated channels. In some implementations, the combining may involve combining the first set of decorrelated and modulated output channels with $N_r$ undecorrelated output channels. According to some implementations, applying the first decorrelation process may involve applying an identical decorrelation process to each of the $N_r$ input audio channels.

In some implementations, the method may involve applying a second decorrelation process to the set of two or more of the input audio channels to produce a second set of decorrelated channels. In some examples, the second decorrelation process may involve maintaining an inter-channel correlation of the set of input audio channels. The method may involve applying a second modulation process to the second set of decorrelated channels to produce a second set of decorrelated and modulated output channels. In some implementations, the combining process may involve combining the second set of decorrelated and modulated output channels with the first set of decorrelated and modulated output channels and with the two or more undecorrelated output channels.

According to some implementations, the first decorrelation process may involve a first decorrelation function and the second decorrelation process may involve a second decorrelation function. In some instances, the second decorrelation function may involve applying the first decorrelation function with a phase shift of approximately 90 degrees or approximately −90 degrees. In some examples, the first modulation may involve a first modulation function and the second modulation process may involve a second modulation function, the second modulation function comprising the first modulation function with a phase shift of approximately 90 degrees or approximately −90 degrees.

In some examples, the decorrelation, modulation and combining processes may produce the output audio signal such that, when the output audio signal is decoded and provided to an array of speakers: a) the spatial distribution of the energy in the array of speakers is substantially the same as the spatial distribution of the energy that would result from the input audio signal being decoded to the array of speakers via a least-squares decoder; and b) the correlation between adjacent loudspeakers in the array of speakers is substantially different from the correlation that would result from the input audio signal being decoded to the array of speakers via a least-squares decoder.

In some examples, receiving the input audio signal may involve receiving a first output from an audio steering logic process. The first output may include the $N_r$ input audio channels. In some such implementations, the method may involve combining the $N_p$ audio channels of the output audio signal with a second output from the audio steering logic process. The second output may, in some instances, include $N_p$ audio channels of steered audio data in which a gain of one or more channels has been altered, based on a current dominant sound direction.

Some or all of the methods described herein may be performed by one or more devices according to instructions (e.g., software) stored on non-transitory media. Such non-transitory media may include memory devices such as those described herein, including but not limited to random access memory (RAM) devices, read-only memory (ROM) devices, etc. For example, the software may include instructions for controlling one or more devices for receiving an input audio signal that includes $N_r$ input audio channels. $N_r$ may be an integer ≥2. In some examples, the input audio signal may represent a first soundfield format having a first soundfield format resolution. The software may include instructions for applying a first decorrelation process to a set of two or more of the input audio channels to produce a first set of decorrelated channels. The first decorrelation process may involve maintaining an inter-channel correlation of the set of input audio channels. The software may include instructions for applying a first modulation process to the first set of decorrelated channels to produce a first set of decorrelated and modulated output channels.

In some implementations, the software may include instructions for combining the first set of decorrelated and modulated output channels with two or more undecorrelated output channels to produce an output audio signal that includes $N_p$ output audio channels. $N_p$ may, in some examples, be an integer ≥3. According to some implementations, the output channels may represent a second soundfield format that is a relatively higher-resolution soundfield format than the first soundfield format. In some examples, the undecorrelated output channels may correspond with lower-resolution components of the output audio signal and the decorrelated and modulated output channels corresponding with higher-resolution components of the output audio signal. In some implementations, the undecorrelated output channels may be produced by applying a least-squares format converter to the $N_r$ input audio channels.

In some examples, the modulation process may involve applying a linear matrix to the first set of decorrelated channels. In some implementations, the combining may involve combining the first set of decorrelated and modulated output channels with $N_r$ undecorrelated output channels. According to some implementations, applying the first decorrelation process may involve applying an identical decorrelation process to each of the $N_r$ input audio channels.

In some implementations, the software may include instructions for applying a second decorrelation process to the set of two or more of the input audio channels to produce a second set of decorrelated channels. In some examples, the second decorrelation process may involve maintaining an inter-channel correlation of the set of input audio channels. The software may include instructions for applying a second modulation process to the second set of decorrelated channels to produce a second set of decorrelated and modulated output channels. In some implementations, the combining process may involve combining the second set of decorrelated and modulated output channels with the first set of decorrelated and modulated output channels and with the two or more undecorrelated output channels.

According to some implementations, the first decorrelation process may involve a first decorrelation function and the second decorrelation process may involve a second decorrelation function. In some instances, the second decorrelation function may involve applying the first decorrelation function with a phase shift of approximately 90 degrees or approximately −90 degrees. In some examples, the first modulation may involve a first modulation function and the second modulation process may involve a second modulation function, the second modulation function comprising the first modulation function with a phase shift of approximately 90 degrees or approximately −90 degrees.

In some examples, the decorrelation, modulation and combining processes may produce the output audio signal such that, when the output audio signal is decoded and provided to an array of speakers: a) the spatial distribution of the energy in the array of speakers is substantially the same as the spatial distribution of the energy that would result from the input audio signal being decoded to the array of speakers via a least-squares decoder; and b) the correlation between adjacent loudspeakers in the array of speakers is substantially different from the correlation that would result from the input audio signal being decoded to the array of speakers via a least-squares decoder.

In some examples, receiving the input audio signal may involve receiving a first output from an audio steering logic process. The first output may include the $N_r$ input audio channels. In some such implementations, the software may include instructions for combining the $N_p$ audio channels of the output audio signal with a second output from the audio steering logic process. The second output may, in some instances, include $N_p$ audio channels of steered audio data in which a gain of one or more channels has been altered, based on a current dominant sound direction.

At least some aspects of this disclosure may be implemented in an apparatus that includes an interface system and a control system. The control system may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components. The interface system may include a network interface. In some implementations, the apparatus may include a memory system. The interface system may include an interface between the control system and at least a portion of (e.g., at least one memory device of) the memory system.

The control system may be capable of receiving, via the interface system, an input audio signal that includes $N_r$ input audio channels. $N_r$ may be an integer ≥2. In some examples, the input audio signal may represent a first soundfield format having a first soundfield format resolution. The control system may be capable of applying a first decorrelation process to a set of two or more of the input audio channels to produce a first set of decorrelated channels. The first decorrelation process may involve maintaining an inter-channel correlation of the set of input audio channels. The control system may be capable of applying a first modulation process to the first set of decorrelated channels to produce a first set of decorrelated and modulated output channels.

In some implementations, the control system may be capable of combining the first set of decorrelated and modulated output channels with two or more undecorrelated output channels to produce an output audio signal that includes $N_p$ output audio channels. $N_p$ may, in some examples, be an integer ≥3. According to some implementations, the output channels may represent a second soundfield format that is a relatively higher-resolution soundfield format than the first soundfield format. In some examples, the undecorrelated output channels may correspond with lower-resolution components of the output audio signal and the decorrelated and modulated output channels corresponding with higher-resolution components of the output audio signal. In some implementations, the undecorrelated output channels may be produced by applying a least-squares format converter to the $N_r$ input audio channels.

In some examples, the modulation process may involve applying a linear matrix to the first set of decorrelated channels. In some implementations, the combining may involve combining the first set of decorrelated and modulated output channels with $N_r$ undecorrelated output channels. According to some implementations, applying the first decorrelation process may involve applying an identical decorrelation process to each of the $N_r$ input audio channels.

In some implementations, the control system may be capable of applying a second decorrelation process to the set of two or more of the input audio channels to produce a second set of decorrelated channels. In some examples, the second decorrelation process may involve maintaining an inter-channel correlation of the set of input audio channels. The control system may be capable of applying a second modulation process to the second set of decorrelated channels to produce a second set of decorrelated and modulated output channels. In some implementations, the combining process may involve combining the second set of decorrelated and modulated output channels with the first set of decorrelated and modulated output channels and with the two or more undecorrelated output channels.

According to some implementations, the first decorrelation process may involve a first decorrelation function and the second decorrelation process may involve a second decorrelation function. In some instances, the second decorrelation function may involve applying the first decorrelation function with a phase shift of approximately 90 degrees or approximately −90 degrees. In some examples, the first modulation may involve a first modulation function and the second modulation process may involve a second modulation function, the second modulation function comprising the first modulation function with a phase shift of approximately 90 degrees or approximately −90 degrees.

In some examples, the decorrelation, modulation and combining processes may produce the output audio signal such that, when the output audio signal is decoded and provided to an array of speakers: a) the spatial distribution of the energy in the array of speakers is substantially the same as the spatial distribution of the energy that would result from the input audio signal being decoded to the array of speakers via a least-squares decoder; and b) the correlation between adjacent loudspeakers in the array of speakers is substantially different from the correlation that would result from the input audio signal being decoded to the array of speakers via a least-squares decoder.

In some examples, receiving the input audio signal may involve receiving a first output from an audio steering logic process. The first output may include the $N_r$ input audio channels. In some such implementations, the control system may be capable of combining the $N_p$ audio channels of the output audio signal with a second output from the audio steering logic process. The second output may, in some instances, include $N_p$ audio channels of steered audio data in which a gain of one or more channels has been altered, based on a current dominant sound direction.

BRIEF DESCRIPTION OF THE DRAWINGS

For a more complete understanding of the disclosure, reference is made to the following description and accompanying drawings, in which.

DETAILED DESCRIPTION OF EXAMPLE EMBODIMENTS

Figure 1A:
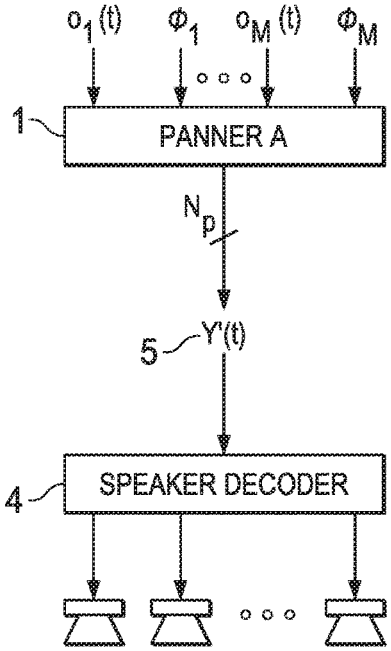
FIG. 1A (PRIOR ART)
FIG. 1A shows an example of a high resolution Soundfield Format being decoded to speakers.

A prior-art process is shown in FIG. 1A, whereby a panning function is used inside Panner A [1], to produce the $N_p$-channel Original Soundfield Signal [5], Y(t), which is subsequently decoded to a set of $N_S$ Speaker Signals, by Speaker Decoder [4] (an $[N_S \times N_p]$ matrix).

In general, a Soundfield Format may be used in situations where the playback speaker arrangement is unknown. The quality of the final listening experience will depend on both (a) the information-carrying capacity of the Soundfield Format and (b) the quantity and arrangement of speakers used in the playback environment.

If we assume that the number of speakers is greater than or equal to $N_p$ (so, $N_S \geq N_p$), then the perceived quality of the spatial playback will be limited by $N_p$, the number of channels in the Original Soundfield Signal [5].

Often, Panner A [1] will make use of a particular family of panning functions known as B-Format (also referred to in the literature as Spherical Harmonic, Ambisonic, or Higher Order Ambisonic, panning rules), and this disclosure is initially concerned with spatial formats that are based on B-Format panning rules.

Figure 1B:
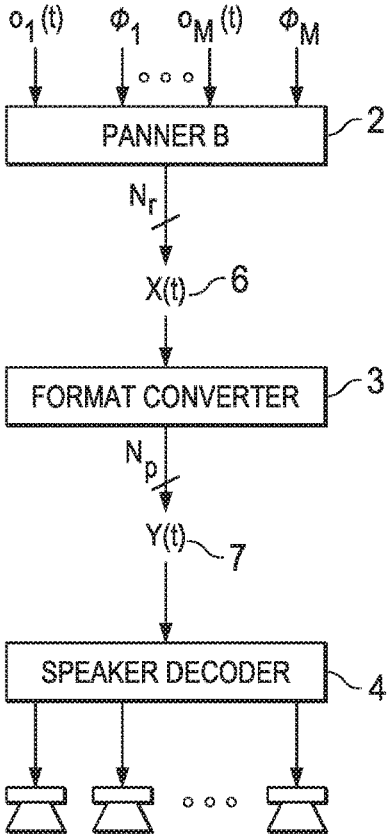
FIG. 1B shows an example of a system wherein a low-resolution Soundfield Format is Format Converted to high-resolution prior to being decoded to speakers.

FIG. 1B shows an alternative panner, Panner B [2], configured to produce Input Soundfield Signal [6], an $N_r$-channel Spatial Format x(t), which is then processed to create an $N_p$-channel Output Soundfield Signal [7], y(t), by the Format Converter [3], where $N_p > N_r$.

This disclosure describes methods for implementing the Format Converter [3]. For example, this disclosure provides methods that may be used to construct the Linear Time Invariant (LTI) filters used in the Format Converter [3], in order to provide an $N_r$-input, $N_p$-output LTI transfer function for our Format Converter [3], so that the listening experience provided by the system of FIG. 1B is perceptually as close as possible to the listening experience of the system of FIG. 1A.

EXAMPLE

BF1H to BF4H

We begin with an example scenario, wherein Panner A [1] of FIG. 1A is configured to produce a $4^{th}$-order horizontal B-Format soundfield, according to the following panner equations (note that the terminology BF4h is used to indicate Horizontal $4^{th}$-order B-Format):

$$P_A(\phi) = P_{BF4h}(\phi) = \begin{pmatrix} 1 \\ \sqrt{2}\cos\phi \\ \sqrt{2}\sin\phi \\ \sqrt{2}\cos 2\phi \\ \sqrt{2}\sin 2\phi \\ \sqrt{2}\cos 3\phi \\ \sqrt{2}\sin 3\phi \\ \sqrt{2}\cos 4\phi \\ \sqrt{2}\sin 4\phi \end{pmatrix} \tag{4}$$

In this case, the variable $\phi$ represents an azimuth angle, $N_p=9$ and $P_{BF4h}(\phi)$ represents a $[9\times1]$ column vector (and hence, the signal Y(t) will consist of 9 audio channels).

Now, lets assume that Panner B [2] of FIG. 1B is configured to produce a $1^{st}$-order B-format soundfield:

$$P_B(\phi) = P_{BF1h}(\phi) = \begin{pmatrix} 1 \\ \sqrt{2}\cos\phi \\ \sqrt{2}\sin\phi \end{pmatrix} \tag{5}$$

Hence, in this example $N_r=3$ and $P_{BF1h}$ (represents a $[3\times1]$ column vector (and hence, the signal X(t) of FIG. 1B will consist of 3 audio channels). In this example, our goal is to create the 9-channel Output Soundfield Signal [7] of FIG. 1B, Y(t), that is derived by an LTI process from X(t), suitable for decoding to any speaker array, so that an optimized listening experience is attained.

Figure 2:
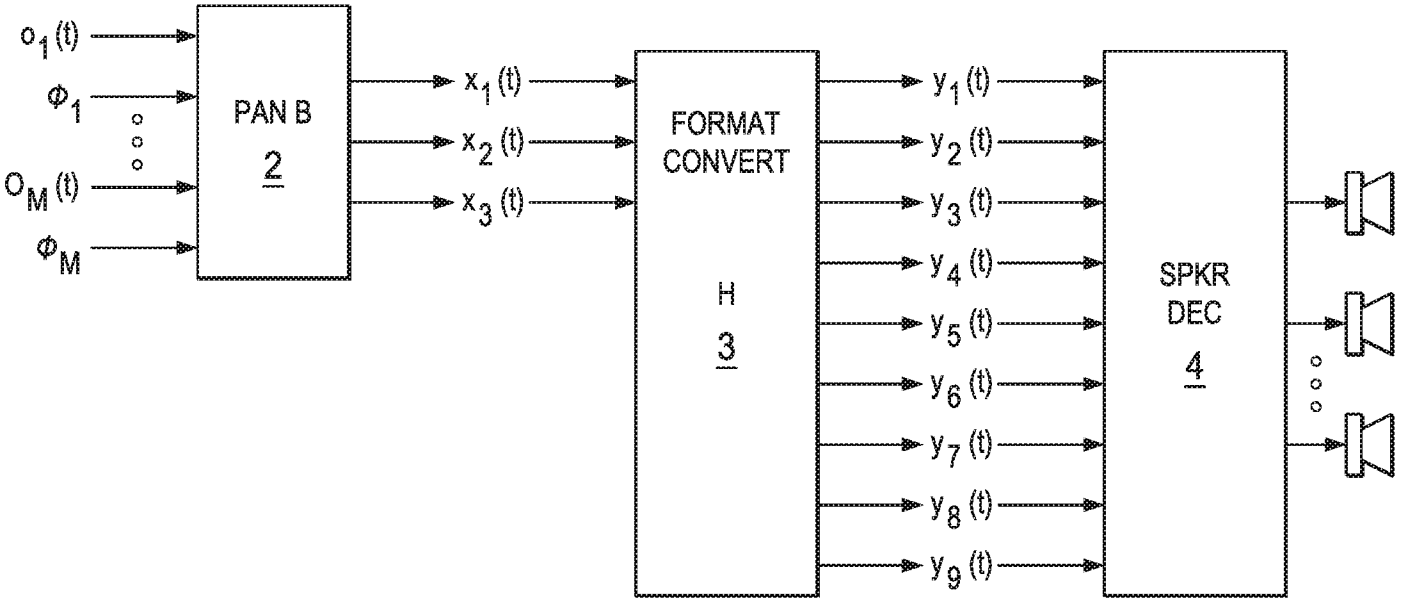
FIG. 2 shows a 3-channel, low-resolution Soundfield Format being Format Converted to a 9-channel, high-resolution Soundfield Format, prior to being decoded to speakers.

As shown in FIG. 2, we will refer to the transfer function of this LTI Format Conversion process as H.

The Speaker Decoder Linear Matrix

In the example shown in FIG. 1B, the Format Converter [3] receives the $N_r$-channel Input Soundfield Signal [6] as input and outputs the $N_p$-channel Output Soundfield Signal [7]. The Format Converter [3] will generally not receive information regarding the final speaker arrangement in the listeners playback environment. We can safely ignore the speaker arrangement if we choose to assume that the listener has a large enough number of speakers (this is the aforementioned assumption, $N_S \geq N_p$), although the methods described in this disclosure will still produce an appropriate listening experience for a listener whose playback environment has fewer speakers.

Having said that, it will be convenient to be able to illustrate the behavior of Format Converters described in this document, by showing the end result when the Spatial Format signals Y(t) and Y(t) are eventually decoded to loudspeakers.

In order to decode an $N_p$-channel Soundfield signal Y(t), to $N_s$ speakers, an $[N_s \times N_p]$ matrix may be applied to the Soundfield Signal, as follows:

$$\text{Spkr}(t) = \text{DecodeMatrix} \times Y(t) \tag{6}$$

If we focus our attention to one speaker, we can ignore the other speakers in the array, and look at one row of DecodeMatrix. We will call this the DecodeRow Vector, $\text{Dec}_N(\phi_S)$, indicating that this row of DecodeMatrix is intended to decode the N-channel Soundfield Signal to a speaker located at angle $\phi_s$.

For B-Format signals of the kind described in Equations 4 and 5, the Decode Row Vector may be computed as follows:

$$Dec_3(\phi_s) = \frac{1}{3}P_{BF1h}(\phi)^T \tag{7}$$

$$\frac{1}{3}P_{BF1h}(\phi)^T = \frac{1}{3}\left(1 \ \sqrt{2}\cos\phi_s \ \sqrt{2}\sin\phi_s\right) \tag{8}$$

$$Dec_9(\phi_s) = \frac{1}{9}P_{BF4h}(\phi)^T \tag{9}$$

$$\frac{1}{9}P_{BF4h}(\phi)^T = \frac{1}{9}\left(1 \ \sqrt{2}\cos\phi_s \ \ldots \ \sqrt{2}\cos 4\phi_s \ \sqrt{2}\sin 4\phi_s\right) \tag{10}$$

Note that $Dec_3(\phi_s)$ is shown here, to allow us to examine the hypothetical scenario whereby a 3-channel BF1h signal is decoded to the speakers. However, only the 9-channel speaker decode Row Vector, $Dec_9(\phi_s)$, is used in some implementations of the system shown in FIG. 2.

Note, also, that alternative forms of the Decode Row Vector, $Dec_9(\phi_s)$, may be used, to create speaker panning curves with other, desirable, properties. It is not the intention of this document to define the best Speaker Decoder coefficients, and value of the implementations disclosed herein does not depend on the choice of Speaker Decoder coefficients.

The Overall Gain from Input Audio Object to Speaker

We can now put together the three main processing blocks from FIG. 2, and this will allow us to define the way an input audio object, panned to location $\phi$, will appear in the signal fed to a speaker that is located at position $\phi_s$ in the listeners playback environment:

$$gain_{3,9}(\phi,\phi_s)=Dec_9(\phi_s)\times H\times P_3(\phi) \tag{11}$$

In Equation 11, $P_3(\phi)$ represents a [3×1] vector of gain values that pans the input audio object, at location $\phi$, into the BF1h format.

In this example, H represents a [9×3] matrix that performs the Format Conversion from the BF1h Format to the BF4h Format.

In Equation 11, $Dec_9(\phi_s)$ represents a [1×9] row vector that decoded the BF4h signal to a loudspeaker located a position $\phi_s$ in the listening environment.

For comparison, we can also define the end-to-end gain of the (prior art) system shown in FIG. 1A, which does not include a Format Converter.

$$gain_9(\phi,\phi_s)=Dec_9(\phi_s)\times P_9(\phi) \tag{12}$$

Figure 3:
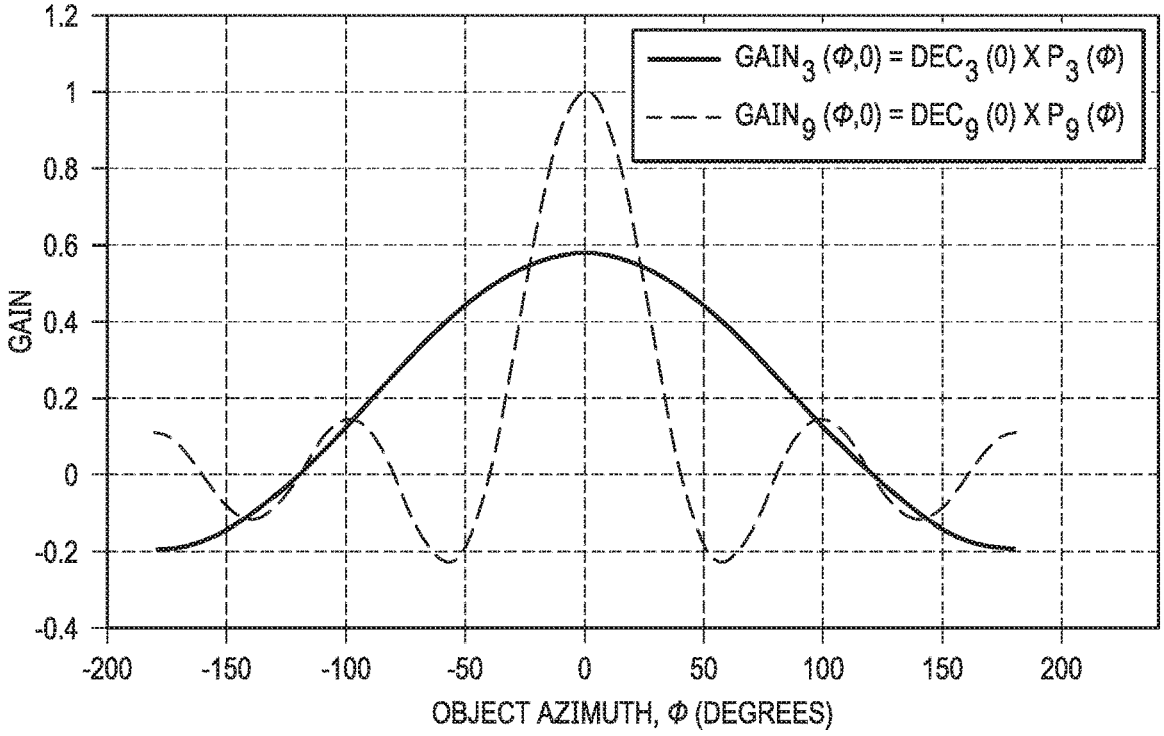
FIG. 3 shows the gain, from an input audio object at angle $\phi$, encoded into a Soundfield Format and then decoded to a speaker at $\phi_s=0$, for two different Soundfield Formats.

The dotted line in FIG. 3 shows the overall gain, $gain_9(\phi, \phi_s)$, from an audio object located at azimuth angle $\phi$ to a speaker located at $\phi_s=0$, when the object is panned into BH4h Soundfield Format (via the Gain Vector $G_{BF4h}(\phi)$) and then decoded by the Decode Row Vector $Dec_9(0)$.

This gain plot shows that the maximum gain from the original object to the speaker occurs when the object is located at the same position as the speaker (at $\phi_S=0$), and as the object moves away from the speaker, the gain falls quickly to zero (at $\phi$=40').

In addition, the solid line in FIG. 3 shows the gain, $gain_3(\phi,\phi_s)$, when an object is panned in the BH1h 3-channel Soundfield Format, and then decoded to a speaker array by the $Dec_3(0)$ Decode Row Vector.

Whats Missing in the Low-Resolution Signal X(T)

When multiple speakers are placed in a circle around the listener, the gain curves shown in FIG. 3 can be re-plotted, to show all of the speaker gains. This allows us to see how the speakers interact with each other.

Figure 4:
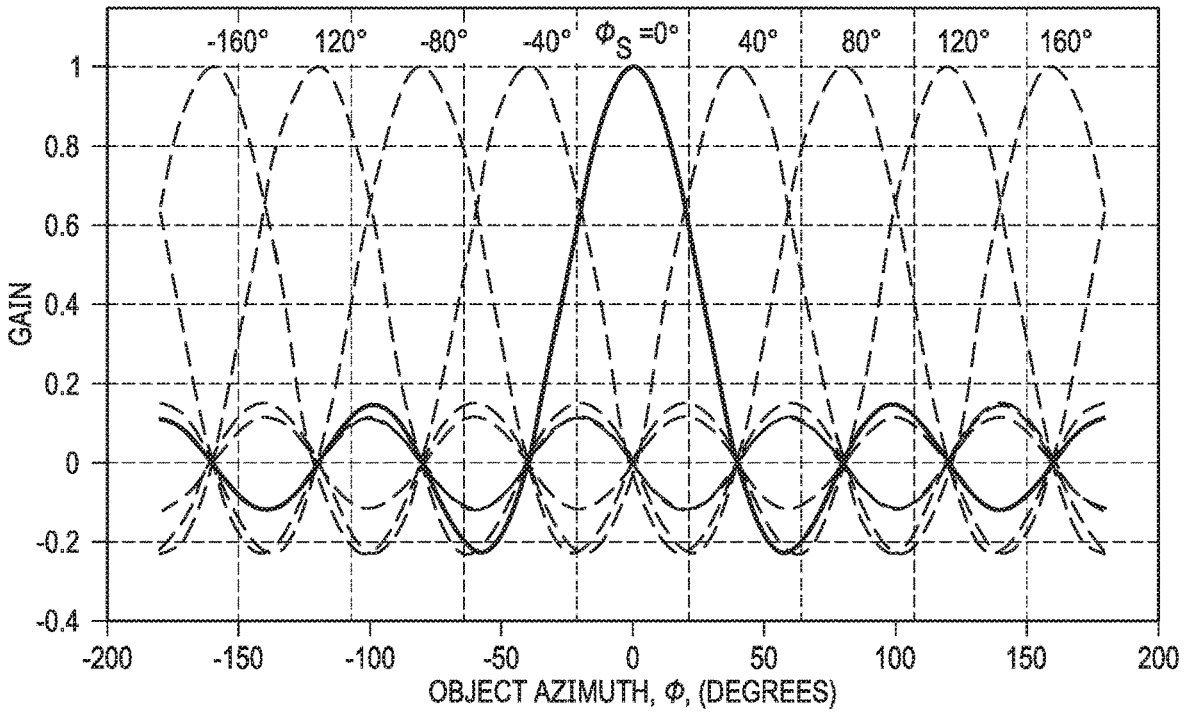
FIG. 4 shows the gain, from an input audio object at angle $\phi$, encoded into a 9-channel BF4h Soundfield Format and then decoded to an array of 9 speakers.
Figure 5:
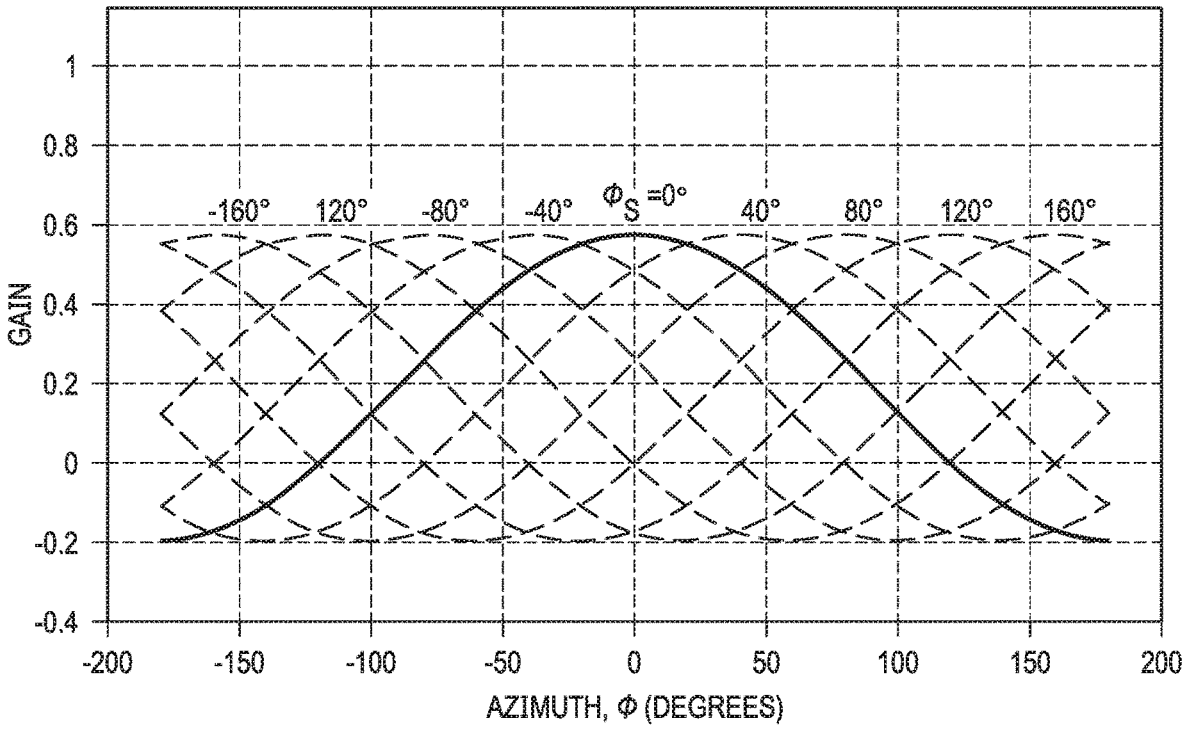
FIG. 5 shows the gain, from an input audio object at angle $\phi$, encoded into a 3-channel BF1h Soundfield Format and then decoded to an array of 9 speakers.

For example, when 9 speakers are placed, at 40° intervals around a listener, the resulting set of 9 gain curves are shown in Figures FIG. 4 and FIG. 5, for the 9-channel and 3-channel cases respectively.

In both Figures FIG. 4 and FIG. 5, the gain at the speaker located at $\phi_s=0$ is plotted as a solid line, and the other speakers are plotted with dotted lines.

Looking at FIG. 4, we can see that when an object is located at $\phi_S=0$, the audio signal for this object will be presented to the front speaker (at $\phi_s=0$) with a gain of 1.0. Also the audio signal from this object will be present to all other speakers with a gain of 0.0.

Qualitatively, based on observation of FIG. 4, we can say that the BH4h Soundfield Format, when decoded through the $Dec_9(\phi_s)$decode Row Vectors, provides a high-quality rendering over 9 speakers, in the sense that an object located at $\phi_s=0$ will appear in the front speaker, with no energy in the other 8 speakers.

Unfortunately, the same qualitative assessment cannot be made in relation to FIG. 5, which shows the result when the BH1h Soundfield Format is decoded to 9 speakers.

The deficiencies of the gain curves of FIG. 5 can be described in terms of two different attributes:

Power Distribution: When an object is located at $\phi_s=0$, the optimal power distribution to the loudspeakers would occur when all power is applied to the front speaker (at $\phi_s=0$) and zero power is applied to the other 8 speakers. The BF1h decoder does not achieve this energy distribution, since a significant amount of power is spread to the other speakers.

Excessive Correlation: When an object, located at $\phi_s=0$, is encoded with the BF1h Soundfield Format and decoded by the $Dec_3(\phi_s)$ Decode Row Vector, the five front speakers (at $\phi_s$=−80°, −40°, 0°, 40°, and 80°) will contain the same audio signal, resulting in a high level of correlation between these five speakers. Furthermore, the rear two speakers (at $\phi_s$=−160° and 160°) will be out-of-phase with the front channels. The end result is that the listener will experience an uncomfortable phasey feeling, and small movements by the listener will result in noticeable combing artefacts.

Prior art methods have attempted to solve the Excessive Correlation problem, by adding decorrelated signal components, with a resulting worsening of the Power Distribution problem.

Some implementations disclosed herein can reduce the correlation between speaker channels whilst preserving the same power distribution.

Designing Better Format Converters

From Equations 4 and 5, we can see that the three panning gain values that define the BF1h format are a subset of the nine panning gain values that define the BF4h format. Hence, the low-resolution signal, X(t) could have been derived from the high-resolution signal, Y(t), by a simple linear projection, $M_p$:

$$X(t) = M_p \times Y'(t) \tag{13}$$

$$M_p \times Y'(t) = \begin{pmatrix} 1 & 0 & 0 & 0 & 0 & 0 & 0 & 0 & 0 \\ 0 & 1 & 0 & 0 & 0 & 0 & 0 & 0 & 0 \\ 0 & 0 & 1 & 0 & 0 & 0 & 0 & 0 & 0 \end{pmatrix} \times Y'(t) \tag{14}$$

Recall that one purpose of the Format Converter [3] in FIG. 1 is to regenerate a new signal Y(t) that provides the end-listener with an acoustic experience that closely matches the experience conveyed by the more accurate signal Y(t). The least-mean-square optimum choice for the operation of the format converter, $H_{LS}$, may be computed by taking the pseudoinverse of $M_p$:

$$Y_{LS}(t) = H_{LS} \times X(t) \tag{15}$$

$$\text{where, } H_{LS} = M_p^+ = \begin{pmatrix} 1 & 0 & 0 \\ 0 & 1 & 0 \\ 0 & 0 & 1 \\ 0 & 0 & 0 \\ 0 & 0 & 0 \\ 0 & 0 & 0 \\ 0 & 0 & 0 \\ 0 & 0 & 0 \\ 0 & 0 & 0 \end{pmatrix} \tag{16}$$

In Equation 16, $M_p^+$ represents the Moore-Penrose pseudoinverse, which is well known in the art.

The nomenclature used here is intended to convey the fact that the Least Squares solution operates by using the Format Conversion Matrix, $H_{LS}$, to produce a new 9-channel signal, $Y_{LS}(t)$ that matches Y(t) as closely as possible in a Least Squares sense.

Figure 6:
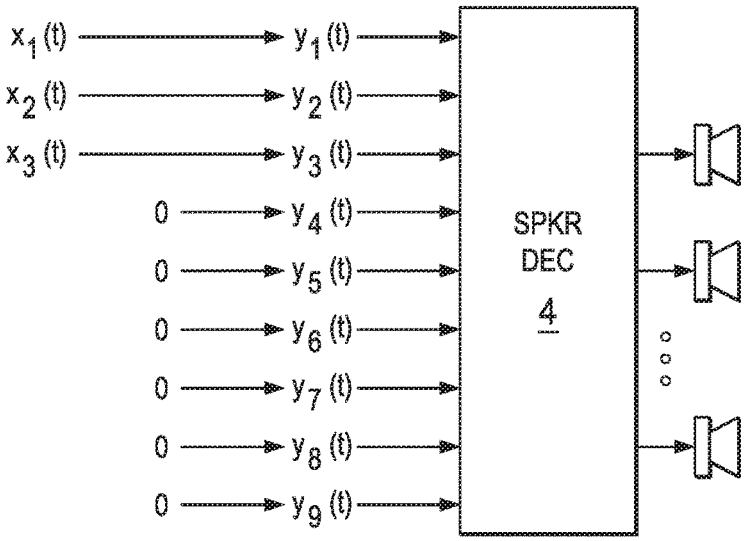
FIG. 6 (PRIOR ART)
FIG. 6 shows a (prior art) method for creating the 9-channel BF4h Soundfield Format from the 3-channel BF1h Soundfield Format.

Whilst the Least-Squares solution ($H_{LS}=M^+$) provides the best fit in a mathematical sense, a listener will find the result to be too low in amplitude because the 3-channel BF1h Soundfield Format is identical to the 9-channel BF4h format with 6 channels thrown away, as shown in FIG. 6. Accordingly, the Least-Squares solution involves eliminating ⅔ of the power of the acoustic scene.

Figure 7:
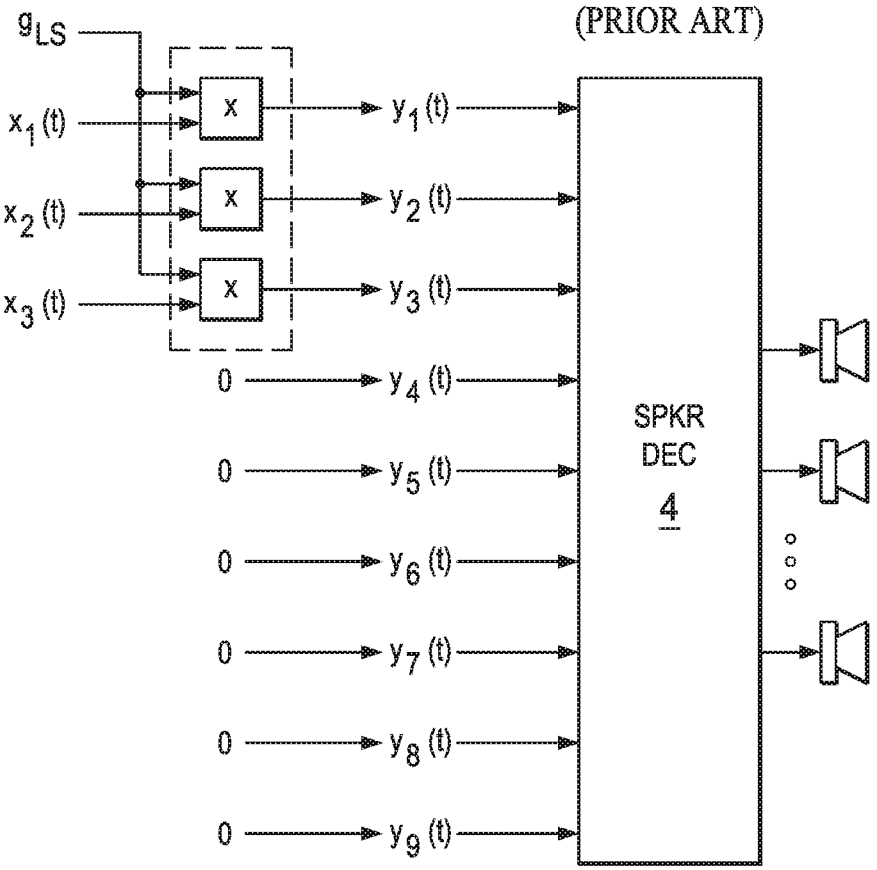
FIG. 7 (PRIOR ART)
FIG. 7 shows a (prior art) method for creating the 9-channel BF4h Soundfield Format from the 3-channel BF1h Soundfield Format, with gain boosting to compensate for lost power.

One (small) improvement could come from simply amplifying the result, as illustrated in FIG. 7. In one such example, the non-zero components $y_1(t)$–$y_3(t)$ of the Least-Squares solution are produced by applying a gain $g_{LS}$ to the non-zero components $x_1(t)$-$x_3(t)$, as follows:

$$H_{LS'} = g_{LS} H_{LS} \tag{17}$$

$$\text{where, } g_{LS} = \sqrt{\frac{N_p}{N_r}} \tag{18}$$

$$\sqrt{\frac{N_p}{N_r}} = \sqrt{3} \tag{19}$$

The Modulation Method for Decorrelation

Whilst the Format Converts of Figures FIG. 6 and FIG. 7 will provide a somewhat-acceptable playback experience for the listener, they can produce a very large degree of correlation between neighboring speakers, as evidenced by the overlapping curves in FIG. 5.

Rather than merely boosting the low-resolution signal components (as is done in FIG. 7), a better alternative is to add more energy into the higher-order terms of the BF4h signals, using decorrelated versions of the BF1h input signals.

Some implementations disclosed herein involve defining a method of synthesizing approximations of one or more higher-order components of Y(t) (e.g., $y_4(t)$, $y_5(t)$, $y_6(t)$, $y_7(t)$, $y_8(t)$ and$y_9(t)$) from one or more low resolution soundfield components of X(t) (e.g., $x_1(t)$, $x_2(t)$ and $x_3(t)$).

In order to create the higher-order components of Y(t), some examples make use of decorrelators. We will use the symbol A to denote an operation that takes an input audio signal, and produces an output signal that is perceived, by a human listener, to be decorrelated from the input signal.

Much has been written in various publications regarding methods for implementing a decorrelator. For the sake of simplicity, in this document, we will define two computationally efficient decorrelators, consisting of a 256-sample delay and a 512-sample delay (using the z-transform notation that is familiar to those skilled in the art):

$$\Delta_1 = z^{-256} \tag{20}$$

$$\Delta_2 = z^{-512} \tag{21}$$

The above decorrelators are merely examples. In alternative implementations, other methods of decorrelation, such as other decorrelation methods that are well known to those of ordinary skill in the art, may be used in place of, or in addition to, the decorrelation methods described herein.

In order to create the higher-order components of Y (t), some examples involve choosing one or more decorrelators (such as $\Delta_1$ and $\Delta_2$ of FIG. 8) and corresponding modulation functions (such as $\text{mod}_1(\phi_s)=\cos 3\phi_s$ and $\text{mod}_2(\phi_s)=\sin 3\phi_s$). In this example, we also define the do nothing decorrelator and modulator functions, $\Delta_0=1$ and $\text{mod}_0(\phi_s)=1$. Then, for each modulation function, we follow these steps:

1. We are given a modulation function, $\text{mod}_k(\phi_s)$. We aim to construct a $[N_p \times N_r]$ matrix (a [9×3] matrix), $Q_k$.

2. Form the product:

$$p = \text{mod}_k \times \text{Dec}_9(\phi_s) \times H_{LS}$$

The product, p, will be a row vector (a [1×3] vector) wherein each element is an algebraic expression in terms of sin and cos functions of $\phi_s$.

3. Solve, to find the (unique) matrix, $Q_k$, that satisfies the identity:

$$p \equiv \text{Dec}_9(\phi_s) \times Q_k$$

Note that, according to this method, when k=0, the do nothing decorrelator, $\Delta_0=1$ (which is not really a decorrelator), and the do nothing modulator function, $\text{mod}_0(\phi_s)=1$, are used in the procedure above, to compute $Q_0=H_{LS}$.

Hence, the three $Q$ matrices, that correspond to the modulation functions $\text{mod}_0(\phi_s)=1$, $\text{mod}_1(\phi_s)=\cos 3\phi_s$ and $\text{mod}_2(\phi_s)=\sin 3\phi_s$, are:

$$Q_0 = \begin{pmatrix} 1 & 0 & 0 \\ 0 & 1 & 0 \\ 0 & 0 & 1 \\ 0 & 0 & 0 \\ 0 & 0 & 0 \\ 0 & 0 & 0 \\ 0 & 0 & 0 \\ 0 & 0 & 0 \\ 0 & 0 & 0 \end{pmatrix} \tag{22}$$

-continued $$Q_1 = \begin{pmatrix} 0 & 0 & 0 \\ 0 & 0 & 0 \\ 0 & 0 & 0 \\ 0 & \frac{1}{\sqrt{2}} & 0 \\ 0 & 0 & \frac{1}{\sqrt{2}} \\ 1 & 0 & 0 \\ 0 & 0 & 0 \\ 0 & \frac{1}{\sqrt{2}} & 0 \\ 0 & 0 & \frac{1}{\sqrt{2}} \end{pmatrix} \tag{23}$$

$$Q_2 = \begin{pmatrix} 0 & 0 & 0 \\ 0 & 0 & 0 \\ 0 & 0 & 0 \\ 0 & 0 & \frac{-1}{\sqrt{2}} \\ 0 & \frac{1}{\sqrt{2}} & 0 \\ 0 & 0 & 0 \\ 1 & 0 & 0 \\ 0 & 0 & \frac{-1}{\sqrt{2}} \\ 0 & \frac{1}{\sqrt{2}} & 0 \end{pmatrix} \tag{24}$$

In this example, the method implements the Format Converter by defining the overall transfer function as the [9×3] matrix:

$$H_{mod}=g_0\times Q_0+g_1\times Q_1\times\Delta_1\times g_2\times Q_2\times\Delta_2 \tag{25}$$

Note that, by setting $g_0=1$ and $g_1=g_2=0$, our system reverts to being identical to the Least-Squares Format Converter under these conditions.

Also, by setting $g_0=\sqrt{3}$ and $g_1=g_2=0$, our system reverts to being identical to the gain-boosted Least-Squares Format Converter under these conditions.

Finally, by setting $g_0=1$ and $g_1=g_2=\sqrt{2}$, we arrive at an embodiment wherein the transfer function of the entire Format Converter can be written as:

$$H_{mod} = \begin{pmatrix} 1 & 0 & 0 \\ 0 & 1 & 0 \\ 0 & 0 & 1 \\ 0 & \frac{\Delta_1}{\sqrt{2}} & \frac{-\Delta_2}{\sqrt{2}} \\ 0 & \frac{\Delta_2}{\sqrt{2}} & \frac{\Delta_1}{\sqrt{2}} \\ \Delta_1 & 0 & 0 \\ \Delta_2 & 0 & 0 \\ 0 & \frac{\Delta_1}{\sqrt{2}} & \frac{-\Delta_2}{\sqrt{2}} \\ 0 & \frac{\Delta_2}{\sqrt{2}} & \frac{\Delta_1}{\sqrt{2}} \end{pmatrix} \tag{26}$$

Figure 8:
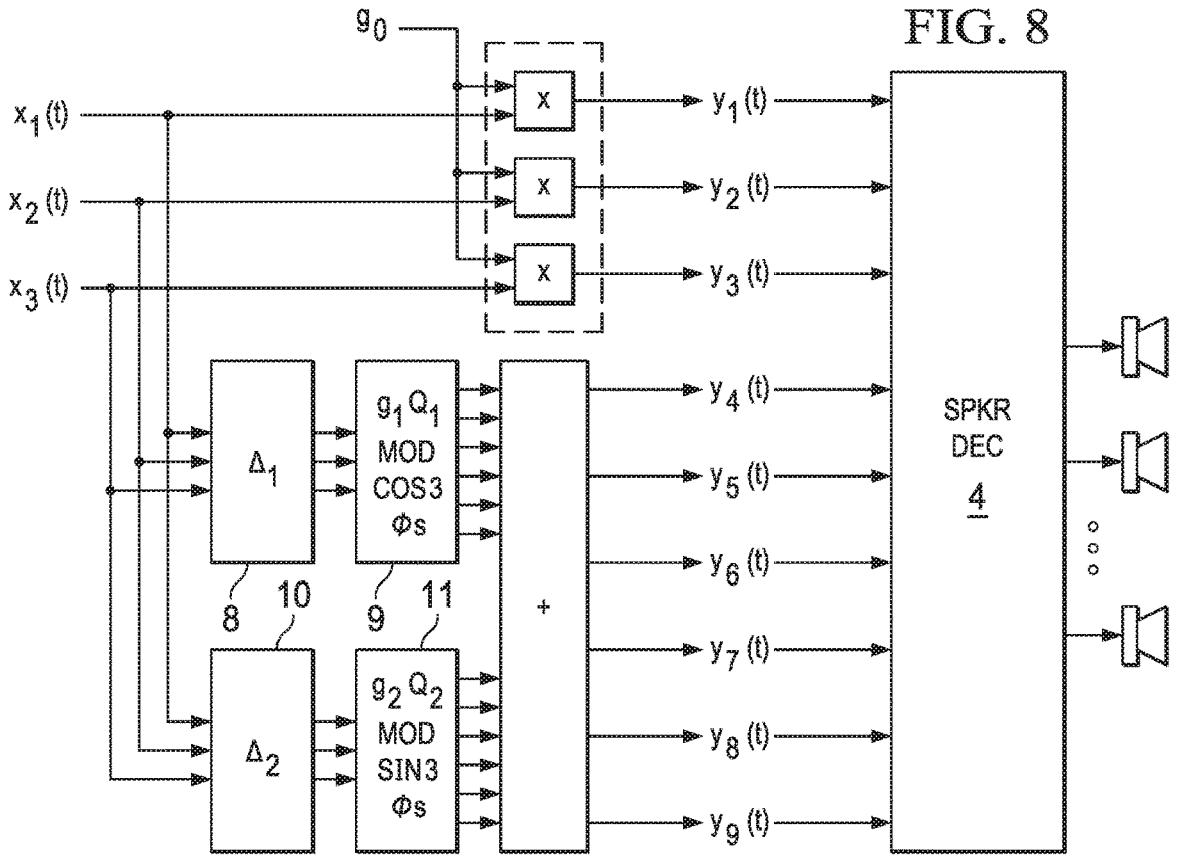
FIG. 8 shows one example of an alternative method for creating the 9-channel BF4h Soundfield Format from the 3-channel BF1h Soundfield Format.

A block diagram for implementing one such method is shown in FIG. 8. Note that the First Modulator [9] receives output from the decorrelator $\Delta_1$, which is meant to indicate that all three channels are modified by the same decorrelator in this example, so that the three output signals may be expressed as:

$$x_1^{dec1}=\Delta_1\times x_1(t)$$

$$x_2^{dec1}=\Delta_1\times x_2(t)$$

$$x_3^{dec1}=\Delta_1\times x_3(t) \tag{27}$$

In Equations (27), $x_1(t)$, $x_2(t)$ and $x_3(t)$ represent inputs to the First Decorrelator [8]. Likewise, for the Second Modulator [11] in FIG. 8, we have:

$$x_1^{dec2}=\Delta_2\times x_1(t)$$

$$x_2^{dec2}=\Delta_2\times x_2(t)$$

$$x_3^{dec2}=\Delta_2\times x_3(t) \tag{28}$$

Figure 9:
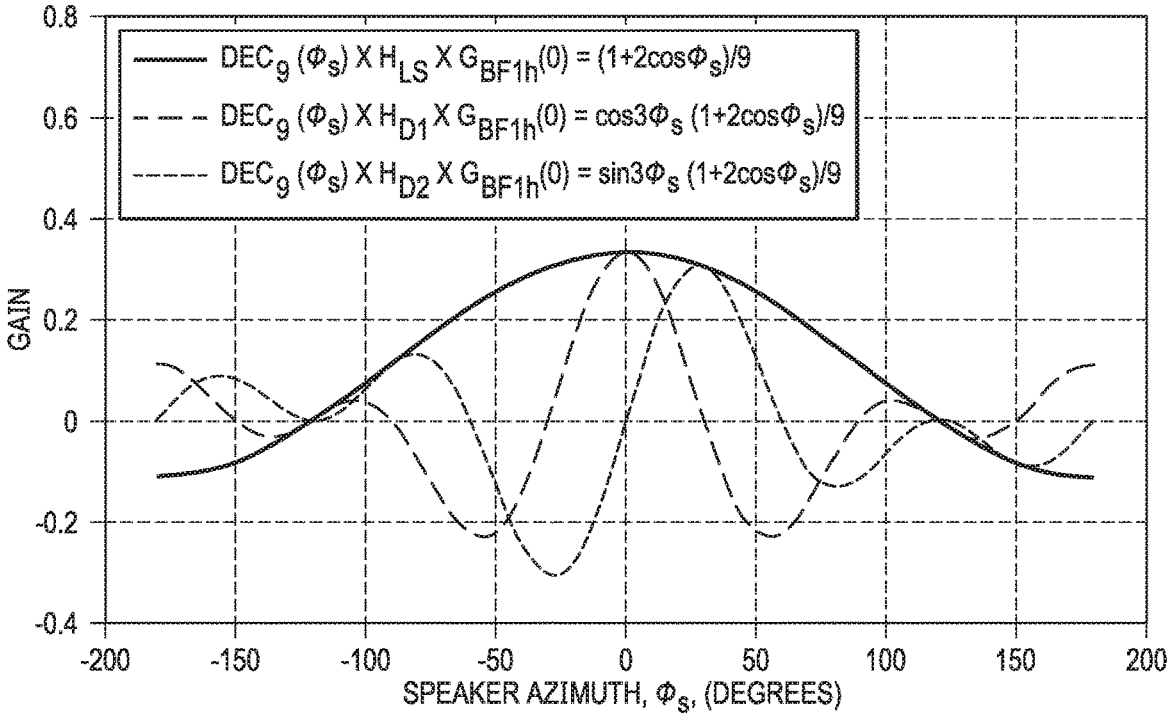
FIG. 9 shows the gain, from an input audio object at angle $\phi=0$, encoded into a 3-channel BF1h Soundfield Format, Format Converted to a 9-channel BF4h Soundfield Format and then decoded to speakers located at positions $\phi_s$.

In order to explain the philosophy behind this method, we look at the solid curve in FIG. 9. This curve shows $gain_{3,9}^{Q0}(0, \phi_s)$, the gain with which an object, located at $\phi=0$ will appear in a speaker, located at $\phi_s$ (if the three-channel BF1h signal was converted to the 9-channel BF4h format using the matrix $Q_0=H_{LS}$). If a number of speakers exists in the listeners playback environment, located at azimuth angles between −120° and +120°, these speakers will all contain some component of the objects audio signal, with a positive gain. Hence, all of these speakers will contain correlated signals.

The other two other gain curves shown here, plotted with dashed and dotted lines, are $gain_{3,9}^{Q1}(0, \phi_s)$ and $gain_{3,9}^{Q2}(0, \phi_s)$ (the gain functions for an object at $\phi_s=0$, as it would appear at a speaker to position $\phi_S$, when the Format Conversion is applied according to $Q_1$ and $Q_2$, respectively). These two gain functions, taken together, will carry the same power as the solid line, but two speakers that are more than 40° apart will not be correlated in the same way.

One very desirable result (from a subjective point of view, according to listener preferences) involves a mixture of these three gain curves, with the mixing coefficients ($g_0$, $g_1$ and $g_2$) determined by listener preference tests.

Using the Hilbert Transform to Form $\Delta_2$

In an alternative embodiment, the second decorrelator may be replaced by:

$$\Delta_2=-\mathcal{H}\{\Delta_1\} \tag{29}$$

In Equation 29, $\mathcal{H}$ represents a Hilbert transform, which effectively means that our second decorrelation process is identical to our first decorrelation process, with an additional phase shift of 90° (the Hilbert transform). If we substitute this expression for $\Delta_2$ into the Second Decorrelator [10] in FIG. 8, we arrive at the new diagram in FIG. 10 in which First Modulator [9], the Second Modulator [11], and the Second Decorrelator [10] of FIG. 8 are replaced by Modulator [13].

In some such implementations, the first decorrelation process involves a first decorrelation function and the second decorrelation process involves a second decorrelation function. The second decorrelation function may equal the first decorrelation function with a phase shift of approximately 90 degrees or approximately −90 degrees. In some such examples, an angle of approximately 90 degrees may be an angle in the range of 89 degrees to 91 degrees, an angle in the range of 88 degrees to 92 degrees, an angle in the range of 87 degrees to 93 degrees, an angle in the range of 86 degrees to 94 degrees, an angle in the range of 85 degrees to 95 degrees, an angle in the range of 84 degrees to 96 degrees, an angle in the range of 83 degrees to 97 degrees, an angle in the range of 82 degrees to 98 degrees, an angle in the range of 81 degrees to 99 degrees, an angle in the range of 80 degrees to 100 degrees, etc. Similarly, in some such examples an angle of approximately −90 degrees may be an angle in the range of −89 degrees to −91 degrees, an angle in the range of −88 degrees to −92 degrees, an angle in the range of −87 degrees to −93 degrees, an angle in the range of −86 degrees to −94 degrees, an angle in the range of −85 degrees to −95 degrees, an angle in the range of −84 degrees to −96 degrees, an angle in the range of −83 degrees to −97 degrees, an angle in the range of −82 degrees to −98 degrees, an angle in the range of −81 degrees to −99 degrees, an angle in the range of −80 degrees to −100 degrees, etc. In some implementations, the phase shift may vary as a function of frequency. According to some such implementations, the phase shift may be approximately 90 degrees over only some frequency range of interest. In some such examples, the frequency range of interest may include a range from 300 Hz to 2 kHz. Other examples may apply other phase shifts and/or may apply a phase shift of approximately 90 degrees over other frequency ranges.

Use of Alternative Modulation Functions

In various examples disclosed herein, the first modulation process involves a first modulation function and the second modulation process involves a second modulation function, the second modulation function being the first modulation function with a phase shift of approximately 90 degrees or approximately −90 degrees. In the procedure described above with reference to FIG. 8, the conversion of BF1h input signals to BF4h output signals involved a first modulation function $\mathrm{mod}_1(\phi_s)=\cos 3\phi_s$ and a second modulation function $\mathrm{mod}_2(\phi_s)=\sin 3\phi_s$. However, other implementations may also be implemented with the use of other modulation functions in which the second modulation function is the first modulation function with a phase shift of approximately 90 degrees or approximately −90 degrees.

For example, the use of the modulation functions, $\mathrm{mod}_1(\phi_s)=\cos 2\phi_s$ and $\mathrm{mod}_2(\phi_s)=\sin 2\phi_s$, lead to the calculation of alternative $Q$ matrices:

$$Q_0 = \begin{pmatrix} 1 & 0 & 0 \\ 0 & 1 & 0 \\ 0 & 0 & 1 \\ 0 & 0 & 0 \\ 0 & 0 & 0 \\ 0 & 0 & 0 \\ 0 & 0 & 0 \\ 0 & 0 & 0 \\ 0 & 0 & 0 \end{pmatrix} \tag{30}$$

-continued $$Q_1 = \begin{pmatrix} 0 & 0 & 0 \\ 0 & \frac{1}{\sqrt{2}} & 0 \\ 0 & 0 & \frac{1}{\sqrt{2}} \\ 1 & 0 & 0 \\ 0 & 0 & 0 \\ 0 & \frac{1}{\sqrt{2}} & 0 \\ 0 & 0 & \frac{1}{\sqrt{2}} \\ 0 & 0 & 0 \\ 0 & 0 & 0 \end{pmatrix} \tag{31}$$

$$Q_2 = \begin{pmatrix} 0 & 0 & 0 \\ 0 & 0 & \frac{-1}{\sqrt{2}} \\ 0 & \frac{1}{\sqrt{2}} & 0 \\ 0 & 0 & 0 \\ 1 & 0 & 0 \\ 0 & 0 & \frac{-1}{\sqrt{2}} \\ 0 & \frac{1}{\sqrt{2}} & 0 \\ 0 & 0 & 0 \\ 0 & 0 & 0 \end{pmatrix} \tag{32}$$

Use of Alternative Output Formats

The examples given in the previous section, using the alternative modulation functions, $\mathrm{mod}_1(\phi_s)=\cos 2\phi_s$ and $\mathrm{mod}_2(\phi_s)=\sin 2\phi_s$, result in $Q$ matrices that contain zeros in the last two rows. As a result, these alternative modulation functions allow the output format to be reduced to the 7-channel BF3h format, with the $Q$ matrices being reduced to 7 rows:

$$Q_0 = \begin{pmatrix} 1 & 0 & 0 \\ 0 & 1 & 0 \\ 0 & 0 & 1 \\ 0 & 0 & 0 \\ 0 & 0 & 0 \\ 0 & 0 & 0 \\ 0 & 0 & 0 \end{pmatrix} \tag{33}$$

$$Q_1 = \begin{pmatrix} 0 & 0 & 0 \\ 0 & \frac{1}{\sqrt{2}} & 0 \\ 0 & 0 & \frac{1}{\sqrt{2}} \\ 1 & 0 & 0 \\ 0 & 0 & 0 \\ 0 & \frac{1}{\sqrt{2}} & 0 \\ 0 & 0 & \frac{1}{\sqrt{2}} \end{pmatrix} \tag{34}$$

-continued $$Q_2 = \begin{pmatrix} 0 & 0 & 0 \\ 0 & 0 & \frac{-1}{\sqrt{2}} \\ 0 & \frac{1}{\sqrt{2}} & 0 \\ 0 & 0 & 0 \\ 1 & 0 & 0 \\ 0 & 0 & \frac{-1}{\sqrt{2}} \\ 0 & \frac{1}{\sqrt{2}} & 0 \end{pmatrix} \quad (35)$$

In an alternative embodiment, the $Q$ matrices may also be reduced to a lesser number of rows, in order to reduce the number of channels in the output format, resulting in the following $Q$ matrices:

$$Q_0 = \begin{pmatrix} 1 & 0 & 0 \\ 0 & 1 & 0 \\ 0 & 0 & 1 \\ 0 & 0 & 0 \\ 0 & 0 & 0 \end{pmatrix} \quad (36)$$

$$Q_1 = \begin{pmatrix} 0 & 0 & 0 \\ 0 & \frac{1}{\sqrt{2}} & 0 \\ 0 & 0 & \frac{1}{\sqrt{2}} \\ 1 & 0 & 0 \\ 0 & 0 & 0 \end{pmatrix} \quad (37)$$

$$Q_2 = \begin{pmatrix} 0 & 0 & 0 \\ 0 & 0 & \frac{-1}{\sqrt{2}} \\ 0 & \frac{1}{\sqrt{2}} & 0 \\ 0 & 0 & 0 \\ 1 & 0 & 0 \end{pmatrix} \quad (38)$$

Other Soundfield Formats

Other soundfield input formats may also be processed according to the methods disclosed herein, including:

BF1 (4-channel, $1^{st}$ order Ambisonics, also known as WXYZ-format), which may be Format Converted to BF3 (16-channel $3^{rd}$ order Ambisonics) using modulation functions such as $mod_1(\phi_s)=\cos 3\phi_s$ and $mod_2(\phi_s)=\sin 3\phi_s$;

BF1 (4-channel, $1^{st}$ order Ambisonics, also known as WXYZ-format), which may be Format Converted to BF2 (9-channel $2^{nd}$ order Ambisonics) using modulation functions such as $mod_1(\phi_s)=\cos 2\phi_s$ and $mod_2(\phi_s)=\sin 2\phi_s$; or BF2 (9-channel, $2^{nd}$ order Ambisonics, also known as WXYZ-format), which may be Format Converted to BF3 (16-channel $6^{th}$ order Ambisonics) using modulation functions such as $mod_1(\phi_s)=\cos 4\phi_s$ and $mod_2(\phi_s)=\sin 4\phi_s$.

It will be appreciated that the modulation methods as defined herein are applicable to a wide range of Soundfield Formats.

Format Converter for Rendering Objects with Size

Figure 11:
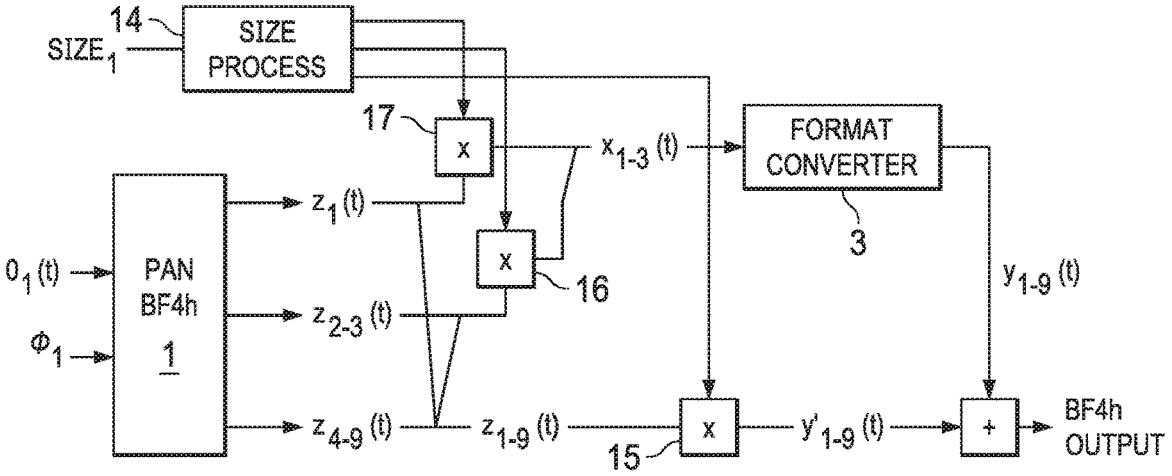
FIG. 11 shows an example of the Format Converter used to render objects with variable size.

FIG. 11 shows a system suitable for rendering an audio object, wherein a Format Converter [3] is used to create a 9-channel BF4h signal, $y_1(t) \ldots y_9(t)$, from a lower-resolution BF1h signal, $x_1(t) \ldots x_3(t)$.

In the example shown in FIG. 11, an audio object, $o_1(t)$ is panned to form an intermediate 9-channel BF4h signal, $z_1(t) \ldots z_9(t)$. This high-resolution signal is summed to the BF4h output, via Direct Gain Scaler [15], allowing the audio object, $o_1(t)$, to be represented in the BF4h output with high resolution (so it will appear to the listener as a compact object).

Additionally, in this implementation the $0^{th}$-order and $1^{st}$-order components of the BF4h signals ($z_1(t)$ and $z_2(t) \ldots z_3(t)$ respectively) are modified by Zeroth Order Gain Scaler [17] and First Order Gain Scaler [16], to form the 3-channel BF1h signal, $x_1(t) \ldots x_3(t)$.

In this example, three gain control signals are generated by Size Process [14], as a function of the $size_1$ parameter associated with the object, as follows:

When $size_1=0$, the gain values are:

$$\{size=0\}\{Gain_{ZerothGain}=0,\ Gain_{FirstGain}=0,\ Gain_{DirectGain}=1\}$$

When $size_1=½$, the gain values are:

$$\left\{size=\frac{1}{2}\right\}\{Gain_{ZerothGain}=1,\ Gain_{FirstGain}=1,\ Gain_{DirectGain}=0\}$$

When $size_1=1$, the gain values are:

$$\{size=1\}\{Gain_{zerothGain}=\sqrt{3},\ Gain_{FirstGain}=0,\ Gain_{DirectGain}=0\}$$

In this example, an audio object having a size=0 corresponds to an audio object that is essentially a point source and an audio object having a size=1 corresponds to an audio object having a size equal to that of the entire playback environment, e.g., an entire room. In some implementations, for values of $size_1$ between 0 and 1, the values of the three gain parameters will vary as piecewise-linear functions, which may be based on the values defined here.

According to this implementation, the BF1h signal formed by scaling the zeroth- and first-order components of the BF4h signal is passed through a format converter (e.g., as the type described previously) in order to generate a format-converted BF4h signal. The direct and format-converted BF4h signals are then combined in order to form the size-adjusted BF4h output signal. By adjusting the direct, zeroth order, and first order gain scalars, the perceived size of the object panned to the BF4h output signal may be varied between a point source and a very large source (e.g., encompassing the entire room).

Format Converter Used in an Upmixer

Figure 12:
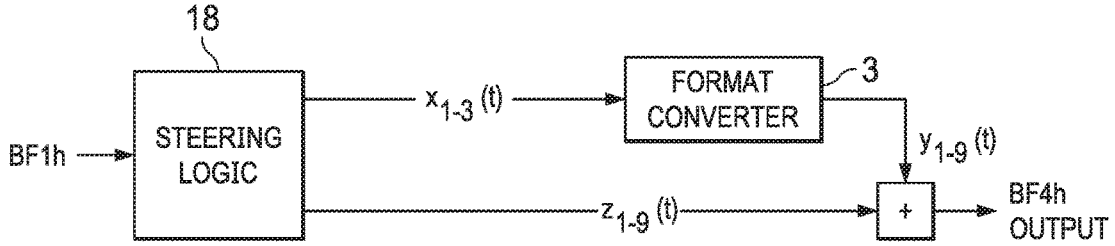
FIG. 12 shows an example of the Format Converter used to process the diffuse signal path in an upmixer system.

An upmixer such as that shown in FIG. 12 operates by use of a Steering Logic Process [18], which takes, as input, a low resolution soundfield signal (for example, BF1h). For example, the Steering Logic Process [18] may identify components of the input soundfield signal that are to be steered as accurately as possible (and processing those components to form the high-resolution output signal $z_1(t) \ldots z_9(t)$). For example, the Steering Logic Process [18] may alter the gain of one or more channels based on a current dominant sound direction and may output $N_p$ audio channels of steered audio data. In the example shown in FIG. 12, p=9 and therefore the Steering Logic Process [18] outputs 9 channels of steered audio data.

Aside from these steered components of the input signal, in this example the Steering Logic Process [18] will emit a residual signal, $x_1(t) \ldots x_3(t)$. This residual signal contains the audio components that are not steered to form the high-resolution signal, In the example shown in FIG. 12, this residual signal, $x_1(t) \ldots x_3(t)$, is processed by the Format Converter [3], to provide a higher-resolution version of the residual signal, suitable for combining with the steered signal, $z_1(t) \ldots z_9(t)$. Accordingly, FIG. 12 shows an example of combining the $N_p$ audio channels of steered audio data with the $N_p$ audio channels of the output audio signal of the format converter in order to produce an upmixed BF4h output signal. Moreover, provided that the computational complexity of generating the BF1h residual signal and applying the format converter to that signal to generate the converted BF4h residual signal is lower than the computational complexity of directly upmixing the residual signals to BF4h format using the steering logic, a reduced computational complexity upmixing is achieved. Because the residual signals are perceptually less relevant than the dominant signals, the resulting upmixed BF4h output signal generated using an upmixer as shown in FIG. 12 will be perceptually similar to the BF4h output signal generated by, e.g., an upmixer which uses steering logic to directly generate both high accuracy dominant and residual BF4h output signals, but can be generated with reduced computational complexity.

Figure 13:
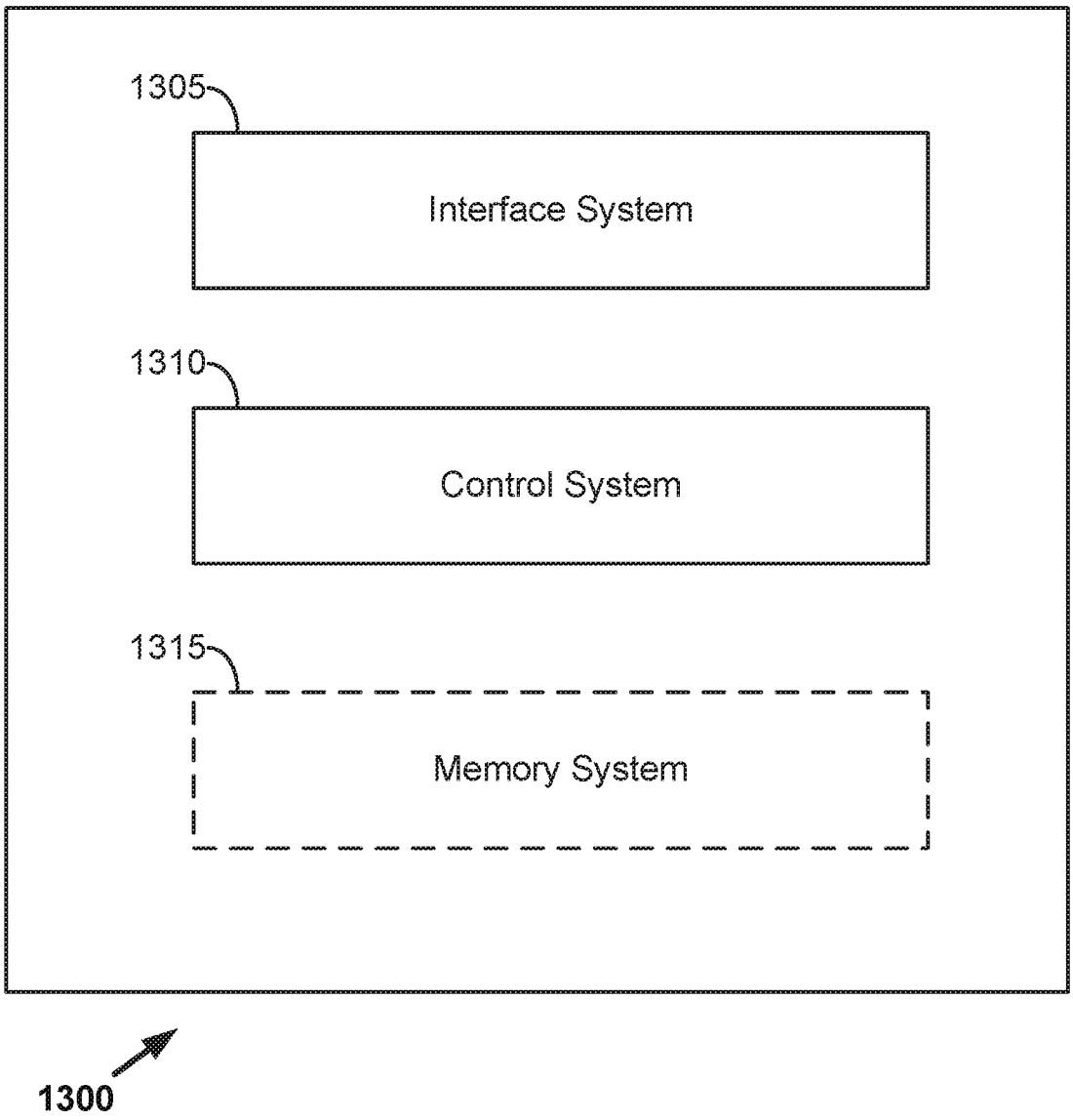
FIG. 13 is a block diagram that shows examples of components of an apparatus capable of performing various methods disclosed herein.

FIG. 13 is a block diagram that provides examples of components of an apparatus capable of implementing various methods described herein. The apparatus 1300 may, for example, be (or may be a portion of) an audio data processing system. In some examples, the apparatus 1300 may be implemented in a component of another device.

In this example, the apparatus 1300 includes an interface system 1305 and a control system 1310. The control system 1310 may be capable of implementing some or all of the methods disclosed herein. The control system 1310 may, for example, include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components.

In this implementation, the apparatus 1300 includes a memory system 1315. The memory system 1315 may include one or more suitable types of non-transitory storage media, such as flash memory, a hard drive, etc. The interface system 1305 may include a network interface, an interface between the control system and the memory system and/or an external device interface (such as a universal serial bus (USB) interface). Although the memory system 1315 is depicted as a separate element in FIG. 13, the control system 1310 may include at least some memory, which may be regarded as a portion of the memory system. Similarly, in some implementations the memory system 1315 may be capable of providing some control system functionality.

In this example, the control system 1310 is capable of receiving audio data and other information via the interface system 1305. In some implementations, the control system 1310 may include (or may implement), an audio processing apparatus.

In some implementations, the control system 1310 may be capable of performing at least some of the methods described herein according to software stored on one or more non-transitory media. The non-transitory media may include memory associated with the control system 1310, such as random access memory (RAM) and/or read-only memory (ROM). The non-transitory media may include memory of the memory system 1315.

Figure 14:
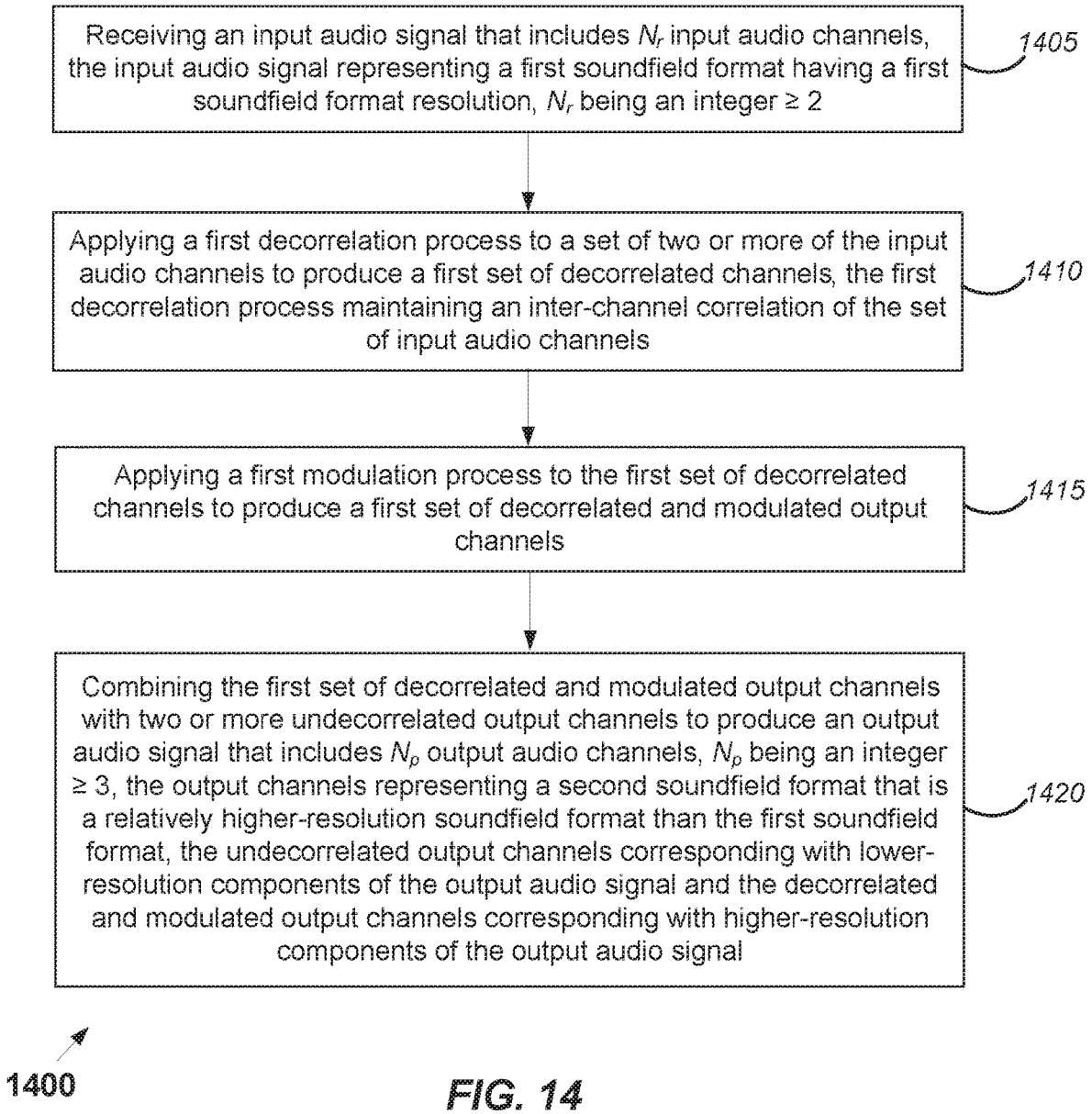
FIG. 14 is a flow diagram that shows example blocks of a method disclosed herein.

FIG. 14 is a flow diagram that shows example blocks of a format conversion process 1400 according to some implementations. The blocks of FIG. 14 (and those of other flow diagrams provided herein) may, for example, be performed by the control system 1310 of FIG. 13 or by a similar apparatus. Accordingly, some blocks of FIG. 14 are described below with reference to one or more elements of FIG. 13. As with other methods disclosed herein, the method outlined in FIG. 14 may include more or fewer blocks than indicated. Moreover, the blocks of methods disclosed herein are not necessarily performed in the order indicated.

Here, block 1405 involves receiving an input audio signal that includes $N_r$ input audio channels. In this example, $N_r$ is an integer ≥2. According to this implementation, the input audio signal represents a first soundfield format having a first soundfield format resolution. In some examples, the first soundfield format may be a 3-channel BF1h Soundfield Format, whereas in other examples the first soundfield format may be a BF1 (4-channel, 1st order Ambisonics, also known as WXYZ-format), a BF2 (9-channel, 2nd order Ambisonics) format, or another soundfield format.

In the example shown in FIG. 14, block 1410 involves applying a first decorrelation process to a set of two or more of the input audio channels to produce a first set of decorrelated channels. According to this example, the first decorrelation process maintains an inter-channel correlation of the set of input audio channels. The first decorrelation process may, for example, correspond with one of the implementations of the decorrelator $\Delta_1$ that are described above with reference to FIG. 8 and FIG. 10. In these examples, applying the first decorrelation process involves applying an identical decorrelation process to each of the $N_r$ input audio channels.

In this implementation, block 1415 involves applying a first modulation process to the first set of decorrelated channels to produce a first set of decorrelated and modulated output channels. The first modulation process may, for example, correspond with one of the implementations of the First Modulator [9] that is described above with reference to FIG. 8 or with one of the implementations of the Modulator [13] that is described above with reference to FIG. 10. Accordingly, the modulation process may involve applying a linear matrix to the first set of decorrelated channels.

According to this example, block 1420 involves combining the first set of decorrelated and modulated output channels with two or more undecorrelated output channels to produce an output audio signal that includes $N_p$ output audio channels. In this example, $N_p$ is an integer ≥3. In this implementation, the output channels represent a second soundfield format that is a relatively higher-resolution soundfield format than the first soundfield format. In some such examples, the second soundfield format is a 9-channel BF4h Soundfield Format. In other examples, the second soundfield format may be another soundfield format, such as a 7-channel BF3h format, a 5-channel BF3h format, a BF2 soundfield format (9-channel $2^{nd}$ order Ambisonics), a BF3 soundfield format (16-channel $3^{rd}$ order Ambisonics), or another soundfield format.

Figure 10:
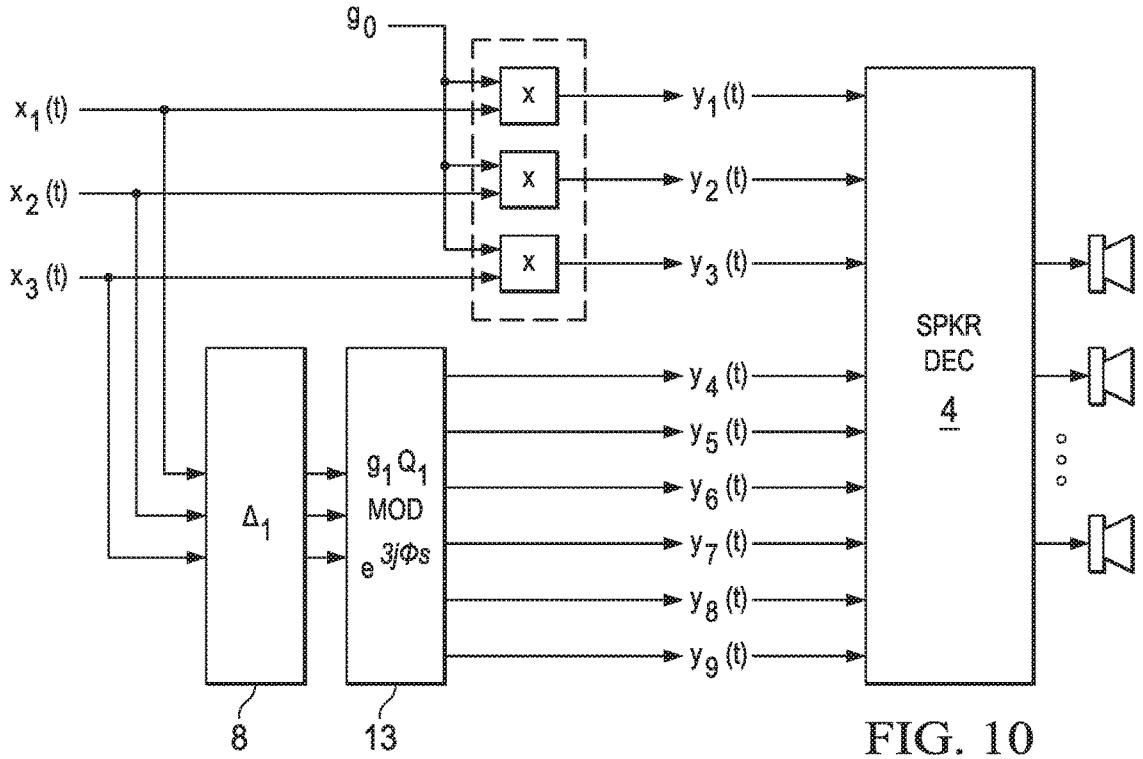
FIG. 10 shows another alternative method for creating the 9-channel BF4h Soundfield Format from the 3-channel BF1h Soundfield Format.

According to this implementation, the undecorrelated output channels correspond with lower-resolution components of the output audio signal and the decorrelated and modulated output channels correspond with higher-resolution components of the output audio signal. Referring to FIGS. 8 and 10, for example, the output channels $y_1(t)$-$y_3(t)$ provide examples of the undecorrelated output channels. Accordingly, in these examples, the combining involves combining the first set of decorrelated and modulated output channels with $N_r$ undecorrelated output channels, wherein $N_r$=3. In some such implementations, the undecorrelated output channels are produced by applying a least-squares format converter to the $N_r$ input audio channels. In the example shown in FIG. 10, output channels $y_4(t)$-$y_9(t)$ provide examples of decorrelated and modulated output channels produced by the first decorrelation process and the first modulation process.

According to some such examples, the first decorrelation process involves a first decorrelation function and the second decorrelation process involves a second decorrelation function, wherein the second decorrelation function is the first decorrelation function with a phase shift of approximately 90 degrees or approximately −90 degrees. In some such implementations, the first modulation process involves a first modulation function and the second modulation process involves a second modulation function, wherein the second modulation function is the first modulation function with a phase shift of approximately 90 degrees or approximately −90 degrees.

In some examples, the decorrelation, modulation and combining produce the output audio signal such that, when the output audio signal is decoded and provided to an array of speakers, the spatial distribution of the energy in the array of speakers is substantially the same as the spatial distribution of the energy that would result from the input audio signal being decoded to the array of speakers via a least-squares decoder. Moreover, in some such implementations, the correlation between adjacent loudspeakers in the array of speakers is substantially different from the correlation that would result from the input audio signal being decoded to the array of speakers via a least-squares decoder.

Some implementations, such as those described above with reference to FIG. 11, may involve implementing a format converter for rendering objects with size. Some such implementations may involve receiving an indication of audio object size, determining that the audio object size is greater than or equal to a threshold size and applying a zero gain value to the set of two or more input audio channels. One example is described above with reference to the Size Process [14] of FIG. 11. In this example, if the sizes parameter is ½ or more, $Gain_{DirectGain}$=0. Therefore, in this example, the Direct Gain Scaler [15] applies a gain of zero to the input channels $z_{1\text{-}9}(t)$.

Some examples, such as those described above with reference to FIG. 12, may involve implementing a format converter in an upmixer. Some such implementations may involve receiving output from an audio steering logic process, the output including $N_p$ audio channels of steered audio data in which a gain of one or more channels has been altered, based on a current dominant sound direction. Some examples may involve combining the $N_p$ audio channels of steered audio data with the $N_p$ audio channels of the output audio signal.

Other Uses of the Format Converter

Various modifications to the implementations described in this disclosure may be readily apparent to those having ordinary skill in the art. The general principles defined herein may be applied to other implementations without departing from the spirit or scope of this disclosure. For example, it will be appreciated that there are many other applications where the Format Converter described in this document will be of benefit. Thus, the claims are not intended to be limited to the implementations shown herein, but are to be accorded the widest scope consistent with this disclosure, the principles and the novel features disclosed herein.

The invention claimed is:

1. A method of processing audio signals, the method comprising:

receiving an input audio signal that includes $N_r$ input audio channels, the input audio signal representing a first soundfield format having a first soundfield format resolution, $N_r$ being an integer ≥2;

applying a first decorrelation process to a set of two or more of the input audio channels to produce a first set of decorrelated channels, the first decorrelation process maintaining an inter-channel correlation of the set of input audio channels;

applying a first modulation process to the first set of decorrelated channels to produce a first set of decorrelated and modulated output channels; and combining the first set of decorrelated and modulated output channels with $N_r$ undecorrelated channels to produce an output audio signal that includes $N_p$ output audio channels, $N_p$ being an integer ≥3, the $N_p$ output channels including the $N_r$ undecorrelated channels corresponding with lower-resolution components of the output audio signal and the decorrelated and modulated output channels corresponding with higher-resolution components of the output audio signal;

wherein at least one of the $N_r$ undecorrelated channels is produced by applying a scale factor to one of the $N_r$ input audio channels.

2. The method of claim 1, wherein the decorrelation, modulation and combining produce the output audio signal such that, when the output audio signal is decoded and provided to an array of speakers:

a) the spatial distribution of the energy in the array of speakers is substantially the same as the spatial distribution of the energy that would result from the input audio signal being decoded to the array of speakers via a least-squares decoder; and b) the correlation between adjacent loudspeakers in the array of speakers is substantially different from the correlation that would result from the input audio signal being decoded to the array of speakers via a least-squares decoder.

3. The method of claim 1, wherein the undecorrelated channels are produced by applying a least-squares format converter to the $N_r$ input audio channels.

4. The method of claim 1, wherein receiving the input audio signal involves receiving a first output from an audio steering logic process, the first output including the $N_r$ input audio channels, further comprising combining the $N_p$ audio channels of the output audio signal with a second output from the audio steering logic process, the second output including $N_p$ audio channels of steered audio data in which a gain of one or more channels has been altered, based on a current dominant sound direction.

5. The method of claim 1, wherein the first soundfield format and the second soundfield format are B-formats.

6. A non-transitory medium having stored thereon instructions for controlling one or more devices for:

receiving an input audio signal that includes $N_r$ input audio channels, the input audio signal representing a first soundfield format having a first soundfield format resolution, $N_r$ being an integer ≥2;

applying a first decorrelation process to a set of two or more of the input audio channels to produce a first set of decorrelated channels, the first decorrelation process maintaining an inter-channel correlation of the set of input audio channels;

applying a first modulation process to the first set of decorrelated channels to produce a first set of decorrelated and modulated output channels; and combining the first set of decorrelated and modulated output channels with $N_r$ undecorrelated channels to produce an output audio signal that includes $N_p$ output audio channels, $N_p$ being an integer >3, the $N_p$ output channels including the $N_r$ undecorrelated channels corresponding with lower-resolution components of the output audio signal and the decorrelated and modulated output channels corresponding with higher-resolution components of the output audio signal;

wherein at least one of the $N_r$ undecorrelated channels is produced by applying a scale factor to one of the $N_r$ input audio channels.

7. An audio signal processing device, comprising:

an interface system; and a controller capable of:

receiving, via the interface system, an input audio signal that includes $N_r$ input audio channels, the input audio signal representing a first soundfield format having a first soundfield format resolution, $N_r$ being an integer ≥2;

applying a first decorrelation process to a set of two or more of the input audio channels to produce a first set of decorrelated channels, the first decorrelation process maintaining an inter-channel correlation of the set of input audio channels;

applying a first modulation process to the first set of decorrelated channels to produce a first set of decorrelated and modulated output channels; and combining the first set of decorrelated and modulated output channels with $N_r$ undecorrelated channels to produce an output audio signal that includes $N_p$ output audio channels, $N_p$ being an integer ≥3, the $N_p$ output channels including the $N_r$ undecorrelated channels corresponding with lower-resolution components of the output audio signal and the decorrelated and modulated output channels corresponding with higher-resolution components of the output audio signal;

wherein at least one of the $N_r$ undecorrelated channels is produced by applying a scale factor to one of the $N_r$ input audio channels.

8. The audio signal processing device of claim 7, wherein the first soundfield format and the second soundfield format are B-formats.

* * * * *